US005540263A

United States Patent [19]

Hustvedt et al.

[11] Patent Number: 5,540,263

[45] Date of Patent: Jul. 30, 1996

[54] APPARATUS AND METHOD FOR PRODUCING INDIVIDUAL SERVINGS OF HOT SOUP FROM SOUP CONCENTRATE

[75] Inventors: David C. Hustvedt, Boulder; James R. Cowles, Denver; James T. Peel, Longmont; Robert J. Alvarez, Westminster, all of Colo.

[73] Assignees: H. J. Heinz Co., Pittsburgh, Pa.; Welbilt Corporation, Stamford, Conn.

[21] Appl. No.: 394,449

[22] Filed: Feb. 27, 1995

[51] Int. Cl.[6] ..... B67D 5/00

[52] U.S. Cl. ..... 141/104; 141/9; 141/11; 141/82; 141/103; 141/250; 141/270; 141/283; 141/284; 141/352; 141/360; 141/373; 239/227; 99/323.3; 222/129.4

[58] Field of Search ..... 141/250, 251, 141/255, 258–260, 351, 352, 358, 360–362, 370, 373, 9, 11, 70, 82, 103, 104, 270, 283, 284; 426/506; 99/323.3; 239/142, 227; 222/129.3, 129.4

[56] References Cited

U.S. PATENT DOCUMENTS

| | | | |
|---|---|---|---|
| 2,552,856 | 5/1951 | Knapp | 222/129.3 X |
| 2,682,984 | 7/1954 | Melikian et al. . | |
| 3,058,667 | 10/1962 | Weiss | 239/227 |
| 3,103,960 | 9/1963 | Simjian | 141/351 X |
| 3,185,348 | 5/1965 | Pollak et al. | 222/95 |
| 3,236,270 | 2/1966 | Stutz | 141/104 |
| 3,340,790 | 9/1967 | Simjian | 99/352 |
| 3,341,078 | 9/1967 | Cardillo | 222/129.4 |
| 3,352,460 | 11/1967 | Herring | 222/129.4 |
| 3,550,814 | 12/1970 | Von Lersner | 222/129.3 |
| 3,578,126 | 5/1971 | Adams | 194/16 |
| 3,662,927 | 5/1972 | Cocks | 222/146 HE |
| 3,676,154 | 7/1972 | Glasser et al. | 99/124 |
| 3,850,345 | 11/1974 | Merritt | 141/258 X |
| 3,915,207 | 10/1975 | Greenfield, Jr. et al. | 141/82 |
| 3,969,531 | 7/1976 | Cornelius | 426/319 |
| 4,094,446 | 6/1978 | Brutsman | 222/146 HE |
| 4,140,809 | 2/1979 | Glasser et al. | 426/589 |
| 4,174,789 | 11/1979 | West | 222/240 |
| 4,176,766 | 12/1979 | West | 222/238 |
| 4,189,071 | 2/1980 | West | 222/189 |
| 4,220,671 | 9/1980 | Kahn et al. | 426/321 |
| 4,322,018 | 3/1982 | Rutter | 222/83 |
| 4,357,861 | 11/1982 | Di Girolamo | 99/323.3 |
| 4,359,935 | 11/1982 | Murray | 99/331 |
| 4,361,176 | 11/1982 | West | 141/362 |
| 4,424,916 | 1/1984 | Pearson | 222/74 |
| 4,470,999 | 9/1984 | Carpiac | 426/506 |
| 4,478,357 | 10/1984 | Jenkins | 222/135 |
| 4,484,697 | 11/1984 | Fry, Jr. | 222/95 |
| 4,544,085 | 10/1985 | Frazer | 222/146.4 |
| 4,568,551 | 2/1986 | Seewi et al. | 426/99 |
| 4,603,793 | 8/1986 | Stern | 222/105 |

(List continued on next page.)

*Primary Examiner*—J. Casimer Jacyna
*Attorney, Agent, or Firm*—Burns, Doane, Swecker & Mathis, L.L.P.

[57] ABSTRACT

The production of hot soup from soup concentrate involves the use of an apparatus that includes a housing having a refrigerated first section and a second section. A soup concentrate container is positioned within the refrigerated section for receiving soup concentrate and a discharge device is operatively associated with the soup concentrate container for discharging a predetermined amount of soup concentrate from the soup concentrate container. A nozzle which is adapted to be connected to a source of hot water is positioned in the second section of the housing for producing a stream of water. A movable tray is also positioned in the second section for receiving a cup or the like in which is to be mixed hot water and soup concentrate. A tray driving device is connected to the tray for moving the tray between various positions at which a cup is placed on the tray, soup concentrate is discharged into the cup and hot water is dispensed into the cup. A nozzle driving device is connected the nozzle for moving the nozzle and effecting a stirring action within the cup through movement of the hot water stream to thereby mix the hot water and soup concentrate in the cup.

27 Claims, 7 Drawing Sheets

U.S. PATENT DOCUMENTS

| | | | |
|---|---|---|---|
| 4,651,862 | 3/1987 | Greenfield, Jr. | 194/344 |
| 4,748,902 | 6/1988 | Maurantonio | 99/326 |
| 4,779,761 | 10/1988 | Rudick et al. | 221/1 |
| 4,784,292 | 11/1988 | Johndrow et al. | 221/101 |
| 4,838,455 | 6/1989 | Hoeberigs | 221/82 |
| 4,860,923 | 8/1989 | Kirschner et al. | 222/1 |
| 4,966,205 | 10/1990 | Tanaka | 141/9 |
| 5,102,015 | 4/1992 | Barnard et al. | 222/135 |
| 5,178,895 | 1/1993 | Duckworth | 426/589 |

FIG. 8
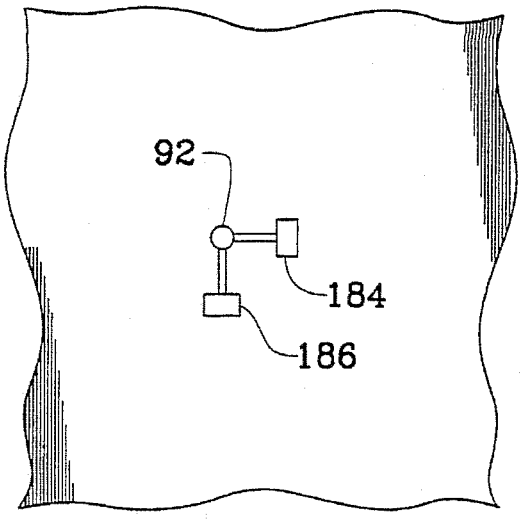
FIG. 9
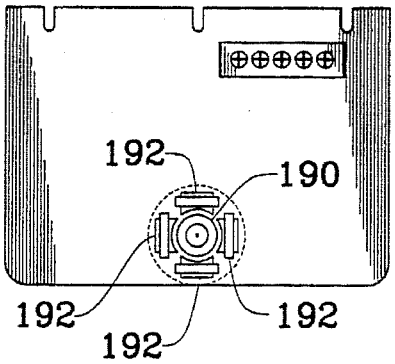
FIG. 10
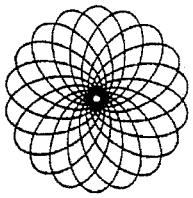
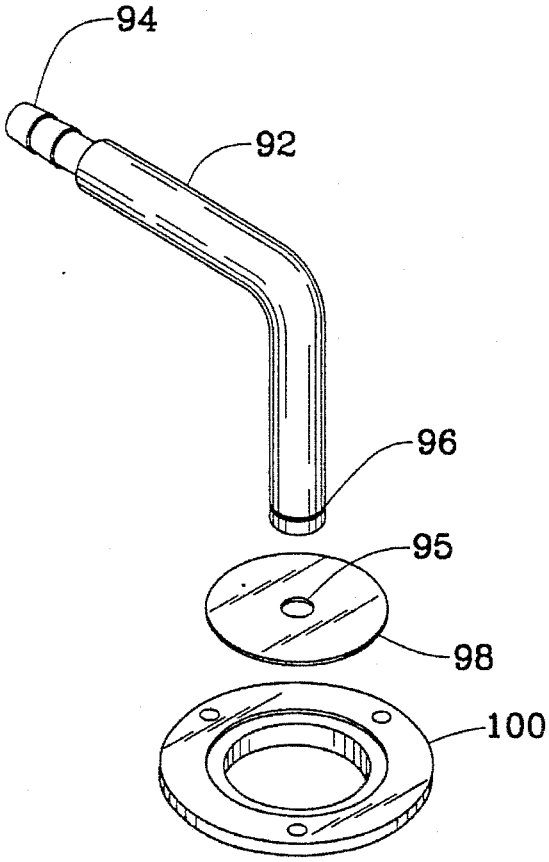
FIG. 4

APPARATUS AND METHOD FOR PRODUCING INDIVIDUAL SERVINGS OF HOT SOUP FROM SOUP CONCENTRATE

FIELD OF THE INVENTION

This invention relates to an apparatus and method for preparing and dispensing food products, and more particularly to an apparatus and method for preparing and dispensing individual servings of hot soup from a refrigerated soup concentrate.

BACKGROUND OF THE INVENTION

Restaurants and other types of food establishments offer consumers a wide variety of food choices. One type of food product which is somewhat popular is soup. In most food establishments, the soup is either made from scratch or is prepared from a can containing the soup product. In the case of canned soup, the soup is either diluted with a particular amount of water and heated or is heated as is from the can. As might be expected, the preparation of soup from scratch or from a can and the subsequent serving of the soup has distinct disadvantages and drawbacks.

For example, in the case of canned soup, the entire contents of the can must be heated regardless of the number of servings desired. Similarly, in the case of soup made from scratch, a large quantity must be prepared. Invariably, a certain portion of the soup remains unused and oftentimes is discarded. Although it may be possible to save and later reheat unused portions of the soup, the quality of the soup may degrade over time with successive reheatings. Also, this manner of preparing large quantities of soup from which individual portions are then served is not well suited to portion control. The aforementioned problems are further compounded when more than one type of soup is served.

Another distinct disadvantage involves the amount of time necessary to prepare the soup. This becomes particularly problematic when the prepared amount of soup is finished before the close of business. In such a situation, it will either be necessary to prepare/heat an additional quantity of soup or inform the customers that soup is no longer available. In light of the foregoing, a need exists for a way of producing soup in a relatively quick and simple manner.

SUMMARY OF THE INVENTION

The present invention is directed to an apparatus and method for producing individual servings of hot soup from a soup concentrate in a fast and efficient manner. In accordance with one aspect of the present invention, the apparatus includes a housing, a pair of soup concentrate containers positioned within the housing for holding soup concentrate, a cooling device for maintaining the soup concentrate in the soup concentrate containers below a predetermined temperature, and a pair of outlets each communicating with a respective one of the soup concentrate containers. A discharging device is operatively associated with each soup concentrate container for discharging a predetermined amount of soup concentrate through the respective outlet. A water tank is provided for holding water, and a heating device is operatively associated with the water tank to heat the water in the water tank. A nozzle is connected to the water tank for discharging a stream of hot water from the water tank. A tray or carousel is adapted to support a cup in which the soup concentrate and the hot water are to be mixed, and a tray driving device moves the tray or carousel. A controller controls the tray driving device in order to move the tray between a plurality of positions that include a first position at which a cup is placed on the tray, and at least one other position at which the predetermined amount of soup concentrate and the hot water are introduced into the cup on the tray. A nozzle driving device is connected to the nozzle for moving the nozzle in a path of movement that causes the hot water stream exiting the nozzle to move across the bottom of the cup positioned on the tray to thereby effect mixing of the soup concentrate and the hot water.

According to another aspect of the present invention, an apparatus for producing soup product from a soup concentrate includes a housing having a refrigerated first section and a separate second section. A soup concentrate container is positioned within the refrigerated section for receiving soup concentrate, and a discharge device is operatively associated with the soup concentrate container for discharging a predetermined amount of soup concentrate from the soup concentrate container. A nozzle is positioned in the second section for producing a stream of water and a hot water conveying device is connected to the nozzle for conveying hot water from a hot water source to the nozzle. A movable receptacle receiving tray is positioned in the second section for receiving a receptacle in which is to be mixed hot water and soup concentrate. A tray driving device is connected to the tray for effecting movement of the tray between a plurality of positions that include an initial position at which a receptacle is placed on the tray, and at least one other position at which the predetermined amount of soup concentrate and the hot water are introduced into the cup on the tray. A nozzle driving device connected to the nozzle moves the nozzle and effects a stirring action within the receptacle through movement of the hot water stream exiting the nozzle.

According to another aspect of the invention, a method of producing individual servings of soup concentrate in a cup involves placing a cup on a movable tray that is located at a first position, moving the tray to a second position, discharging a predetermined amount of soup concentrate into the cup, directing a stream of hot water through a nozzle and into the cup containing the predetermined amount of soup concentrate while simultaneously moving the nozzle so that the stream of hot water moves across a bottom of the cup to effect mixing of the hot water and the soup concentrate, and moving the tray to a cup removal position at which the cup is positioned to be removed from the tray.

BRIEF DESCRIPTION OF THE DRAWING FIGURES

The foregoing features in addition to others will become more apparent from the detailed description set forth below considered in conjunction with the drawing figures in which like elements bear like reference numerals and wherein:

FIG. 4 is an exploded perspective view of the manner in which the nozzle is mounted for pivoting movement within the apparatus;

Figure 11:
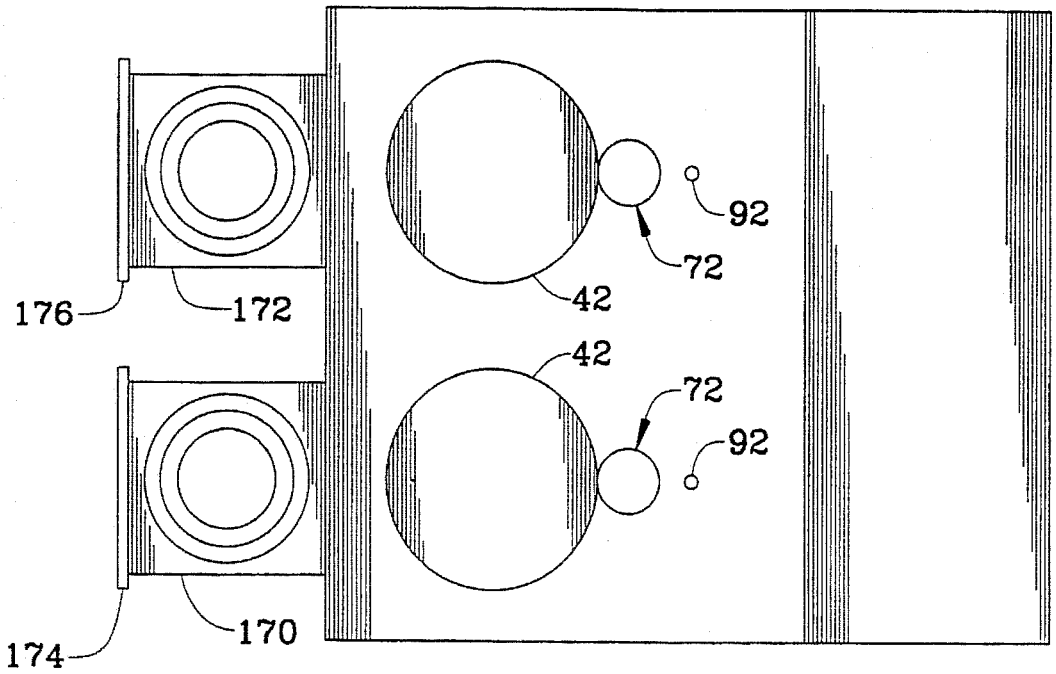
Figure 12A:
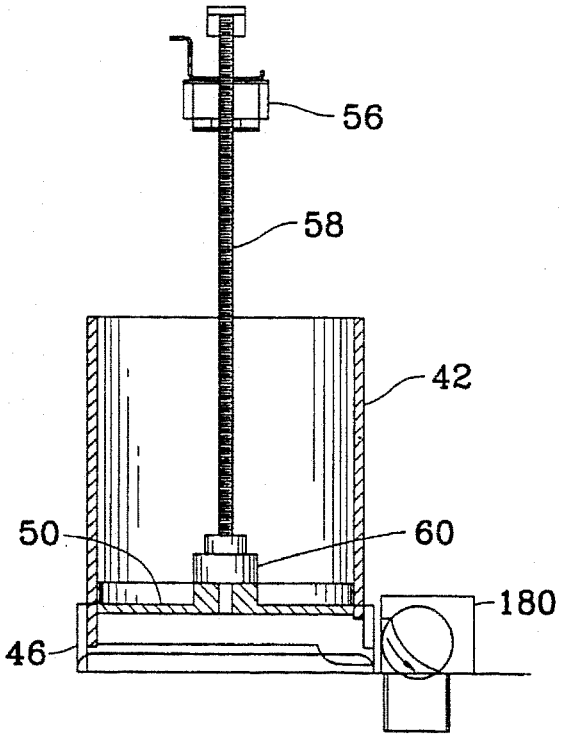
Figure 12B:
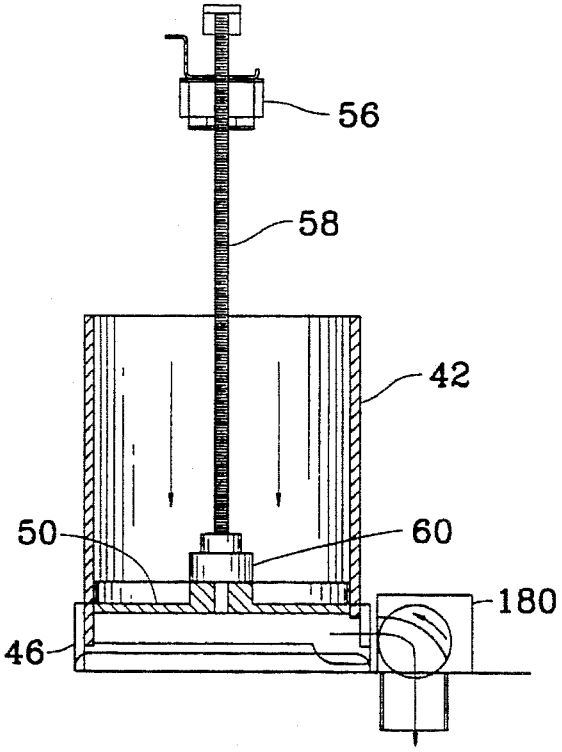

FIGS. 7(*a*)–7(*d*) schematically illustrate the operational sequence of the apparatus;

FIG. 8 is a top view of the nozzle illustrating an alternative driving arrangement for effecting pivoting movement of the nozzle;

FIG. 9 is a top view of another alternative embodiment of the driving arrangement for effecting pivoting movement of the nozzle;

FIG. 10 is an illustration of the path of movement of the hot water stream resulting from the nozzle driving arrangement shown in FIG. 9;

FIG. 11 is a top view illustrating an alternative embodiment of the apparatus employing two linearly movable side-by-side cup receiving trays; and FIGS. 12(*a*)–12(*b*) illustrate an alternative embodiment of the arrangement for controlling the discharge of soup concentrate from the soup concentrate container.

DETAILED DESCRIPTION OF THE INVENTION

Figure 1:
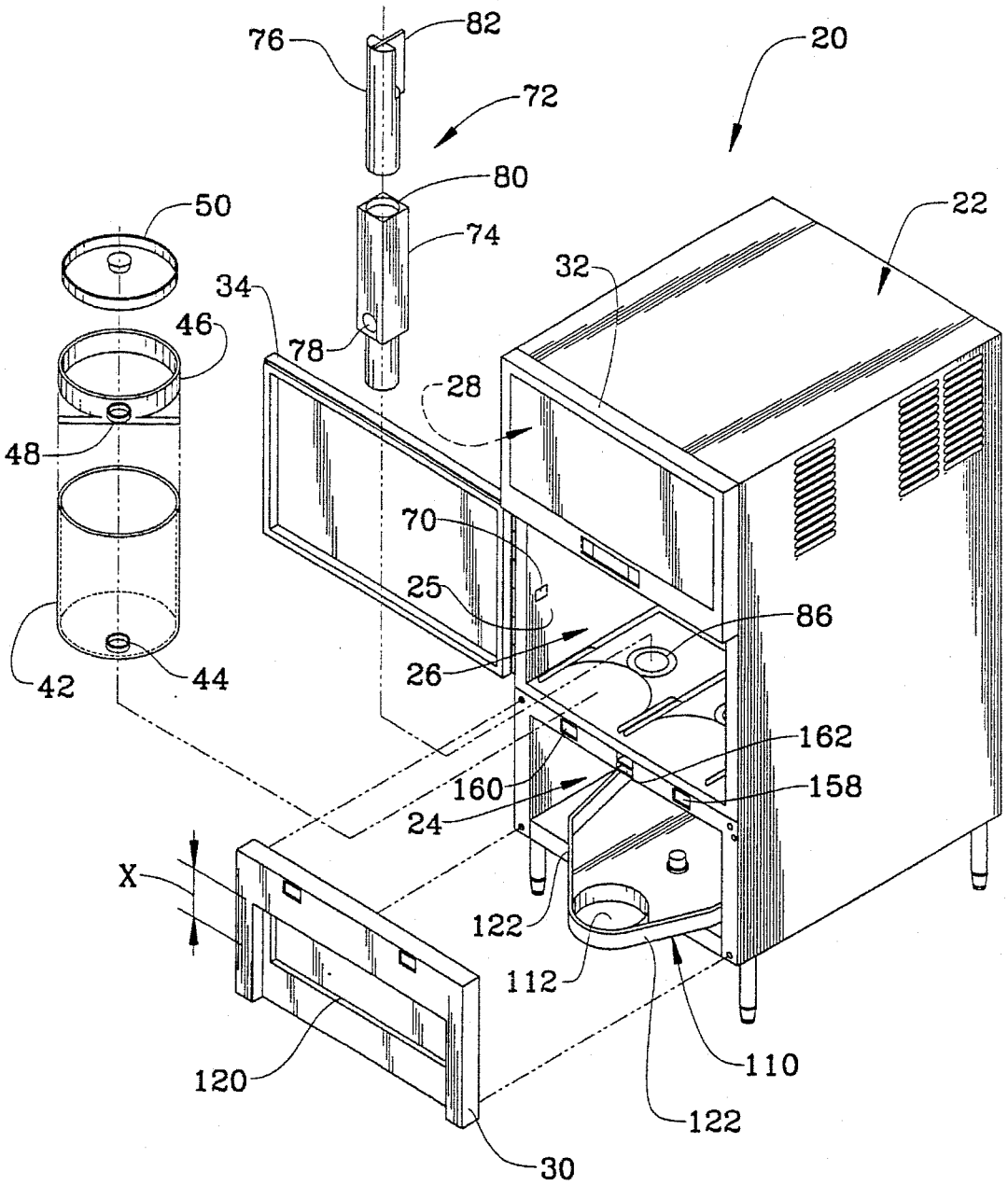
FIG. 1 is a top perspective exploded view of the apparatus in accordance with one embodiment of the present invention.
Figure 3:
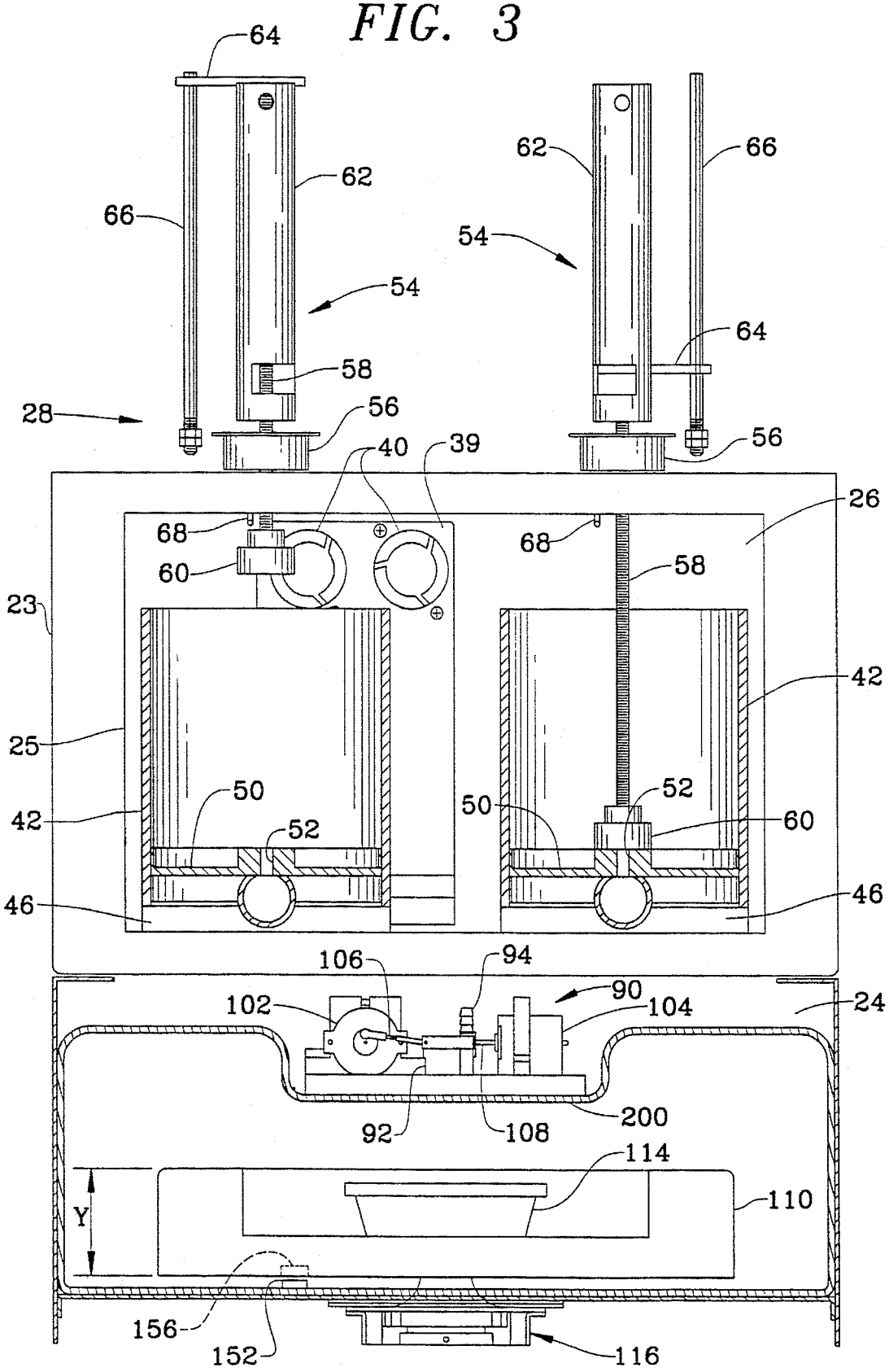
FIG. 3 is a front view, partially in cross section, of the apparatus depicted in FIG. 1.

Referring initially to FIG. 1, the apparatus 20 for producing hot soup from soup concentrate includes a housing or frame 22 that is divided into a lower section 24, an intermediate refrigerated section 26, and an upper section 28. As seen in FIG. 3, the housing 22 is comprised of a metal outer casing 23. In addition, in the refrigerated intermediate section 26, a plastic shell 25 is provided for purposes of insulation. A cover 30 is removably secured to the lower section 24 of the housing and another cover 32 is removably secured to the upper section 28 of the housing. An openable and closable door 34 is mounted on the housing 22 to cover the intermediate section 26 and provide relatively easy access to the components located in the interior of the intermediate section 26.

As mentioned above, the intermediate section 26 is refrigerated for reasons that will become more apparent from the description below. Thus, the apparatus is provided with a condenser 36 (FIG. 2) and an evaporator 38 which includes several fans 40 (see FIG. 3).

The apparatus according to the present invention is designed to produce hot soup from soup concentrate that is maintained in a refrigerated condition in the refrigerated intermediate section 26. The soup concentrate is stored in two soup concentrate containers 42 that are adapted to be supported in a side-by-side manner on a shelf within the refrigerated intermediate section 26 as seen in FIG. 3. The soup concentrate containers 42 are removable so that when a soup concentrate container is emptied or when it is desired to replace the soup concentrate with a different soup concentrate, the soup concentrate containers 42 can be readily removed and refilled or replaced with a different container 42. Guides can be provided along the shelf to properly guide and position the containers at the appropriate place within the intermediate section 26 of the housing 22.

Each of the soup concentrate containers 42 is generally cylindrical and includes a through opening 44 in the vertically extending wall of the container. In addition, a nozzle ring 46 is adapted to encircle each of the soup concentrate containers 42. Each nozzle ring 46 is rotatable with respect to the respective container 42 and is provided with a through hole 48. The through hole 48 in each nozzle ring 46 is adapted to be aligned with and moved out of alignment with the through opening 44 in the soup concentrate container 42 by rotating the nozzle ring 46 with respect to the respective container 42. When the through hole 48 in the nozzle ring 46 is aligned with the through opening 44 in the soup concentrate container 42, soup concentrate in the container 42 can be readily discharged from the container 42. On the other hand, by rotating the nozzle ring 46 so that the through hole 48 in the nozzle ring 46 is out of alignment with the through opening 44 in the container 42, it is possible to avoid inadvertent discharge of soup concentrate from the container 42. For example, when the soup concentrate container 42 is removed from the housing 22 for refilling, soup concentrate can be poured into the container 42 without risk that the soup concentrate will flow out of the through opening 44. Once the soup concentrate container 42 has been filled and placed in the interior of the intermediate section 26 of the housing 22, the nozzle ring 46 can be rotated to align the through hole 48 in the nozzle ring 46 with the through opening 44 in the container 42.

A separate discharge arrangement is also provided for discharging soup concentrate from each of the soup concentrate containers 42. The discharge arrangement for each container includes a piston 50 which is slidably fitted within the interior of each container 42. As illustrated in FIG. 3, the outer diameter of the piston 50 is designed to substantially correspond to the inner diameter of the soup concentrate container 42. As also seen in FIG. 3, the piston 50 can be provided with a hole 52 through which can be inserted a thermometer or the like for measuring the temperature of the soup concentrate in the container 42.

With continued reference to FIG. 3, the discharging arrangement for discharging soup concentrate from the soup concentrate containers 42 also includes a separate piston drive device 54 operatively associated with each of the soup concentrate containers 42. Each piston drive device 54 is disposed in the upper section 28 of the housing 22 and consists of a stepper motor 56 for driving a drive rod 58 in a vertical manner within an enclosed casing 62. The stepper motor 56 is designed to operate in a step-wise manner. Attached to the end of the drive rod 58 is a piston contacting member 60 that is adapted to contact the piston 50 and thereby urge the piston 50 downwardly within the container 42. An anti-rotation arm 64 is connected to the upper end of the drive rod 58 and extends outwardly through a slot in the enclosed casing 62 to prevent the drive rod 58 from rotating. The anti-rotation arm 64 is slidably mounted on a guide rod 66 that is fixed at an appropriate part of the housing.

The stepper motor 56 is designed to move the drive rod 58 and the attached piston contacting member 60 over a predetermined vertical distance during each successive operation of the stepper motor 56. The predetermined amount of movement of the drive rod 58 and the piston contacting member 60 is designed to effect the discharge of a predetermined amount of soup concentrate from the soup concentrate container 42. The predetermined amount of soup concentrate is selected on the basis of, for example, the size of the soup serving to be produced (i.e., the size of the cup) as well as the water to soup concentrate ratio that is necessary to produce the desired soup product. Thus, by changing the number of steps by which the stepper motor 56 is incremented, it is possible to control the amount of soup concentrate discharged from the soup concentrate container 42.

A sensor 68 can also be provided on the upper wall of the intermediate section 26 to sense when the drive rod 58 has reached its uppermost position. When the sensor 68 determines that the drive rod 58 has reached its uppermost position, the motor 56 is turned off. This is useful when the container 42 has been emptied or when it is desired to replace the container 42 since in such a situation it is necessary that the drive rod 58 be lifted before removing the container 42. Preferably, the system is designed so that when the drive rod 58 reaches its downwardmost position (i.e., the container 42 is empty) further soup making operations are prohibited with respect to the soup concentrate contained in the empty container.

When a soup concentrate container 42 containing soup concentrate is positioned within the intermediate section 26 of the housing, the piston contacting member 60 must be brought into engagement with the piston 50 so that subsequent operation of the stepper motor 56 will result in a discharge of the desired amount of soup concentrate. To effect this result, a button 70 (see FIG. 1) can be provided on the interior of the housing in the intermediate section 26. Upon actuation of the button 70, the stepper motor 56 will be operated to advance the drive rod 58 to bring the piston contacting member 60 into engagement with the piston 50. The button 70 is held until the piston contacting member 60 reaches the desired position. Thus, the discharge arrangement will be in a position to discharge the predetermined amount of soup concentrate the next time the stepper motor 56 is actuated.

When the soup concentrate container is emptied or when it is desired to move the drive rod 58 upwardly before the container 42 is emptied, the button 70 can also be used to effect such a result. The system can be designed so that the button 70 is set by the opening of the door 34. Thus, when the door 34 is opened, the first time the button 70 is actuated causes the drive rod 58 to move upwardly until the sensor or switch 68 limiting the upward movement of the drive rod 58 is activated. Thereafter, the next time the button 70 is actuated, the drive rod 58 will move downwardly until the button is released. This second actuation of the button 70 allows the piston contacting member 60 to be brought into engagement with the piston 50 as described above.

Figure 2:
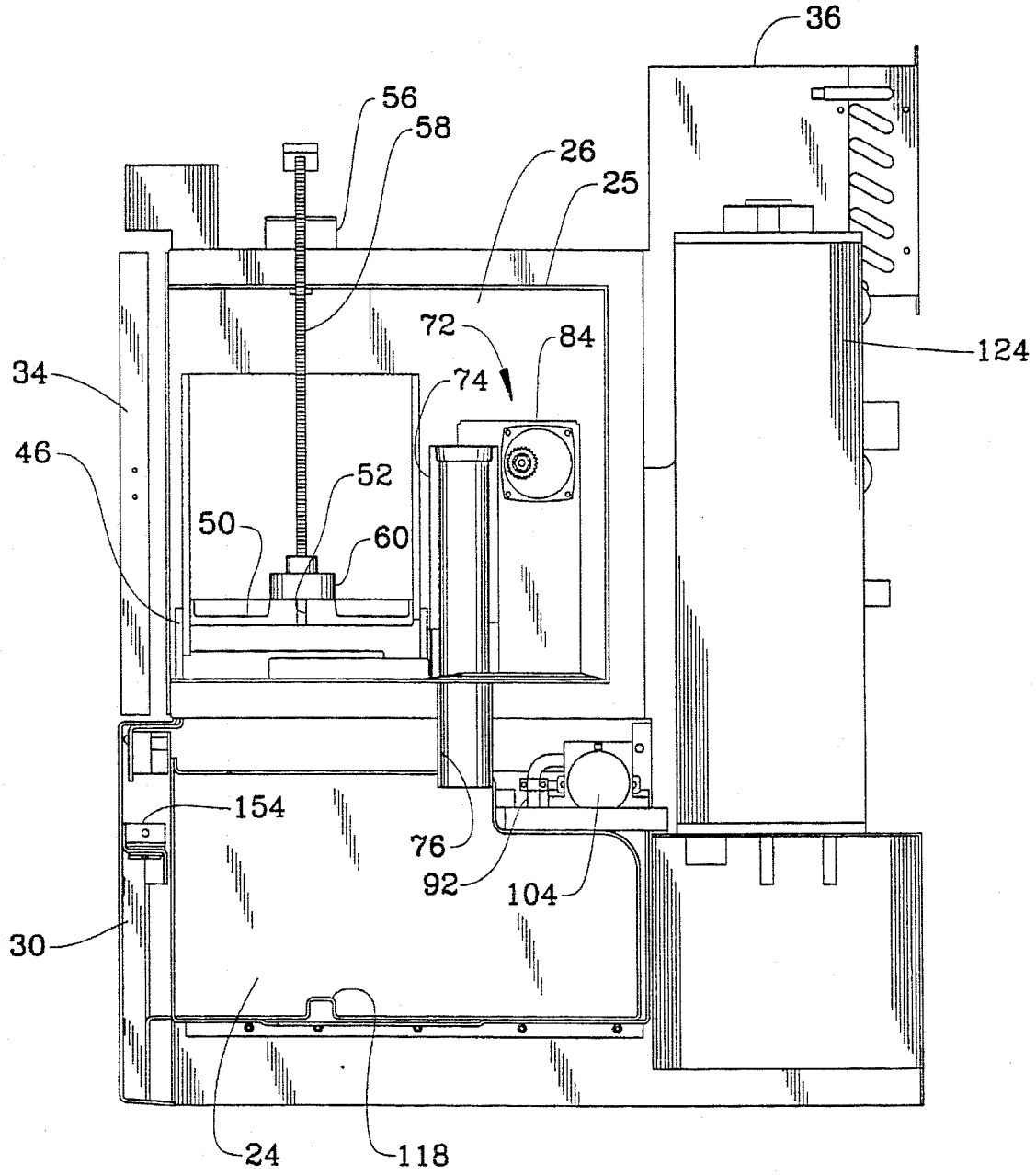
FIG. 2 is a cross-sectional side view of the apparatus shown in FIG. 1.

As seen with reference to FIG. 1 and 2, the apparatus 20 is also provided with a mechanism for closing the through opening 44 in each soup concentrate container 42 after a predetermined amount of soup concentrate has been discharged from the container 42. In accordance with the embodiment shown in FIGS. 1 and 2, that mechanism 72 also serves as a displacer assembly for displacing the predetermined amount of soup concentrate discharged from the container 42. Each mechanism 72 includes a hollow transfer cylinder 74 in which is movably disposed a transfer piston 76. The transfer cylinder 74 is provided with a through hole 78 that communicates with the hollow interior of the transfer cylinder 74 and a slot 80 on the side opposite the through hole 78. The slot 80 opens to the top end of the transfer 74 cylinder and preferably extends downwardly along a portion of the longitudinal extent of the transfer cylinder 74.

The transfer piston 76 is provided with a rack 82 that is adapted to be positioned in the slot 80 in the transfer cylinder 74. As seen in FIG. 2, the transfer piston 76 is adapted to be driven in a vertical manner within the transfer cylinder 74 by a motor 84 that is provided with a slip gear. The slot 80 in the transfer cylinder 74 allows the gear associated with the motor 84 to engage the rack 82 on the transfer piston 76. The outer diameter of the transfer piston 76 is preferably sized to substantially correspond to the inner diameter of the transfer cylinder 74.

As seen in FIG. 1, each transfer cylinder 74 includes a lower portion that is designed to extend through an opening 86 in the support shelf that supports the soup concentrate containers 42. Each transfer cylinder 74 is provided with a shoulder that is adapted to rest on the support shelf.

The through hole 78 in each transfer cylinder 74 is aligned with the through opening 44 in the respective soup concentrate container 42. In that way, soup concentrate discharged from the container 42 through the through opening 44 flows directly into the interior of the transfer cylinder 74 by way of the through hole 78. The operation of the piston driving mechanism 54 and the displacer assembly 72 is coordinated so that after a predetermined amount of soup concentrate is discharged from the soup concentrate container 42, the displacer piston 76 moves downwardly within the displacer cylinder 74 to close off the through hole 78 in the transfer cylinder 74. Additionally, the downward movement of the transfer piston 76 forces the soup concentrate out of the lower outlet end of the transfer cylinder 74.

As seen with reference to FIGS. 2 and 3, a single nozzle assembly 90 is positioned in the lower section 24 of the housing 22 at a point between the two side-by-side soup concentrate containers 42. The nozzle assembly 90 includes a nozzle 92 having an upper end 94 that is adapted to be connected to a hot water delivery line. The nozzle 92 is mounted so as to pivot at a point adjacent the tip end of the nozzle 92. As seen more clearly in FIG. 4, the nozzle 92 is provided with an annular groove 96 adjacent the tip end from which the stream of water is delivered. The tip end of the nozzle 92 is adapted to be fitted in a centrally located hole 95 provided in a disk 98 that is made of rubber gasket material so that the annular groove 96 engages the periphery of the hole 95. The disk 98 is mounted in a clamp ring 100 which is suitably fixed within the housing. As a result of this arrangement, the nozzle 92 is free to pivot in any desired plane.

With reference once again to FIGS. 2 and 3, the nozzle assembly 90 also includes a driving mechanism for effecting pivoting movement of the nozzle 92. In the embodiment shown in FIGS. 2 and 3, that driving mechanism consists of two dc motors 102, 104 each provided with a crank 106, 108. Each of the cranks 106, 108 is oriented perpendicular to the drive shaft of the respective motor 102, 104. Further, the cranks 106, 108 are connected to the nozzle 92 at points that are spaced approximately ninety degrees from one another.

The operation of one of the motors 102 causes the nozzle 92 to move in the left and right direction with respect to the view seen in FIG. 3 (i.e., in the plane of the paper in FIG. 3), while the operation of the other motor 104 causes the nozzle 92 to move forward and backward with respect to the view shown in FIG. 3 (i.e., into and out of the plane of the paper in FIG. 3). Thus, the motor 102 causes the nozzle 92 to move in one plane of movement while the other motor 104 causes the nozzle 92 to move in a perpendicularly oriented plane of movement. By appropriately adjusting the speed of each of the motors 102, 104, the hot water stream exiting the nozzle 92 can be moved in a path that generally outlines a rectangular area. This movement of the nozzle 92 is advantageous in several respects. First, by designing the nozzle to pivot, the stream of hot water exiting the nozzle 92 serves as a stirring mechanism for stirring the soup concentrate and hot water mixture. Thus, there is no need for a separate mixing mechanism to mix the soup concentrate and hot water. Further, since the outline of the movement path of the stream of hot water exiting the nozzle 92 generally defines a rectangle, it is possible to cover substantially the entire bottom surface of the cup during the movement of the nozzle 92. This is useful as it has been found that complete and effective mixing of the soup concentrate and hot water requires that the entire or substantially the entire bottom of the cup be covered by the hot water stream from the nozzle.

A water tank or boiler 124 is positioned in the rear portion of the housing 122 and is connected to the end 94 of the nozzle 92 through a suitable hot water line. The hot water tank 124 is provided with a heater 126 (see FIG. 5) to heat the water and maintain the water temperature within a predetermined range. Preferably, the water is maintained in the tank 124 at a temperature between 220° F.–230° F.

Also mounted within the lower section 24 of the housing 22 is a rotatable tray or carousel 110. The tray 110 is provided with a recess 112 adjacent its forward end for receiving a cup or a cup-like receptacle 114 as seen in FIG. 3.

A tray driving mechanism 116 is positioned on the underside of the housing for driving the tray 110 in a rotatable manner within the lower section 24. The tray driving device 116 can be designed as a stepper motor with gears that effect rotational movement of the tray 110. Preferably, the tray 110 is supported on a protuberance 118 that extends upwardly from the bottom of the lower section 24 as seen in FIG. 2. The drive mechanism from the tray driving device 116 extends through the protuberance 118 to engage the tray 110. The protuberance 118 is effective in preventing water and contaminants from infiltrating into the tray driving device 116. That is, if small amounts of water or soup fall into the bottom of the lower section 24, the protuberance 118 helps ensure that such liquid products do not flow downwardly into the tray driving device 116.

As seen in FIG. 1, the tray 110 is designed so that in its initial position, the front part of the tray 110 extends outwardly through an opening 120 in the cover 30. The front part of the tray 110 preferably extends outwardly through the opening 120 by a distance that is sufficient to permit placement of a cup or receptacle 114 in the recess 112 of the tray 110.

As illustrated in FIG. 3, the height of the side walls on the tray 110 increase from the forwardmost end of the tray 110 rearwardly, thereby providing a height at the forwardmost end of the tray 110 that facilitates the removal of a cup placed on the tray 110. Also, the front portion of the tray 110 includes side walls 122 that angle rearwardly from the forwardmost end of the tray 110. Thus, the intermediate section 24 can be made smaller in size than would otherwise be the case and the tray 110 can rotate under the driving action of the tray driving device 116 without coming into contact with the walls of the housing 22. In addition, the forwardmost end of the tray 110 possesses a height that is significantly less than the height x of the opening 120 in the cover 30. On the other hand, as seen in FIG. 3, the rearward end of the tray 110 possesses a height y that is equal to or substantially equal to the height x of the opening 120 in the cover 30. Also, the rearward end of the tray 110 possesses a length that is equal to or substantially equal to the length of the opening 120 in the cover 30. Thus, the rearward end of the tray 110 possesses a size and configuration that is substantially the same as the size and configuration of the opening 120 in the cover 30. Further, the distance between the rotational axis of the tray 110 and the rearward end of the tray 110 substantially corresponds to the distance between the rotational axis of the tray and the opening 120 in the cover.

The advantage associated with the aforementioned arrangement is that when the tray 110 is rotated to position the cup or receptacle 114 below the nozzle 92 for receiving hot water, the opening 120 in the cover 30 will be substantially closed by the rearward end of the tray 10. Thus, to the extent any splashing occurs while the cup 114 is being filled and the contents simultaneously stirred, such splashing will be contained within the lower section 24. Further, the individual operating the machine will not be able to inadvertently place their fingers through the opening 120 in the cover 30 during the filling and mixing stage of operation.

The front of the housing 22 is provided with two dispenser buttons 158, 160 as seen in FIG. 1. Each button 158, 160 is operatively associated with the soup dispensing and mixing mechanism on the respective side of the machine. A suitable marking will be provided adjacent each button 158, 160 to identify the type of soup which will result from actuation of the button. The actuation of either button 158, 160 will initiate the soup making operation which will be described in more detail below.

An on/off switch 162 is also provided on the front of the housing 122 to turn the apparatus on and off. If the on/off switch 162 is actuated when the apparatus is on, the heater 126 is automatically turned off and hot water is drained from the hot water tank 124 through the hot water drain 130 by activation of the associated valve 134. On the other hand, if the apparatus is off when the on/off switch 162 is actuated, water flows into the tank 124 from the cold water inlet 128 by activation of the associated valve 134 and the heater 126 is turned on to initiate heating of the water.

Figure 5:
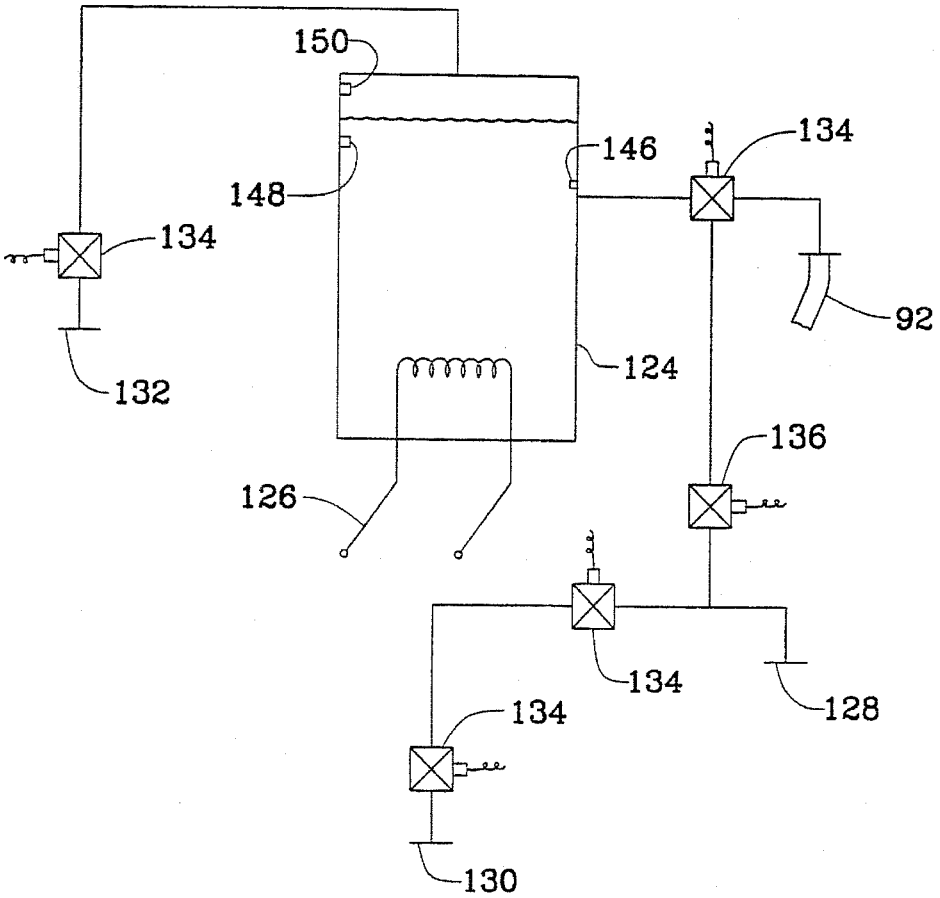
FIG. 5 is a schematic illustration of the piping system for the apparatus.

FIG. 5 generally illustrates a piping system that can be employed in connection with the apparatus of the present invention. The hot water tank 124 is provided with a heater 126 for heating the water and maintaining the water temperature within the preferred temperature range mentioned above. The hot water tank 124 is connected to the nozzle 92 by a hot water line and is connected to a cold water inlet 128. The water tank 124 is further connected to a hot water drain 130 to drain the hot water tank 124 and a fill vent and steam outlet 132 to vent the tank 124. The pipes or other suitable lines extending between the hot water tank 124 and each of the fill vent/steam outlet 132, the nozzle 92, the cold water inlet 128 and the hot water drain 130 are each provided with electrically operated valves 134.

The cold water inlet 128 is designed to provide a source of cold water for initially filling the hot water tank 124 and for replenishing hot water that is removed through the nozzle 92. In addition, the cold water inlet 128 is connected to the line which conveys hot water from the tank 124 to the nozzle 92. A sub-cooling valve 136 is provided to intermittently pump small amounts (e.g., 2–5%) of cold water into the hot water line which delivers hot water to the nozzle 92. This sub-cooling water stream effectively prevents flashing in the nozzle 92 as well as in the line that connects the nozzle 92 to the hot water tank 124. In the absence of the sub-cooling water stream, the hot water exiting the nozzle 92 and even in the line connecting the tank 124 to the nozzle 92 would have a tendency to turn into steam.

Figure 6:
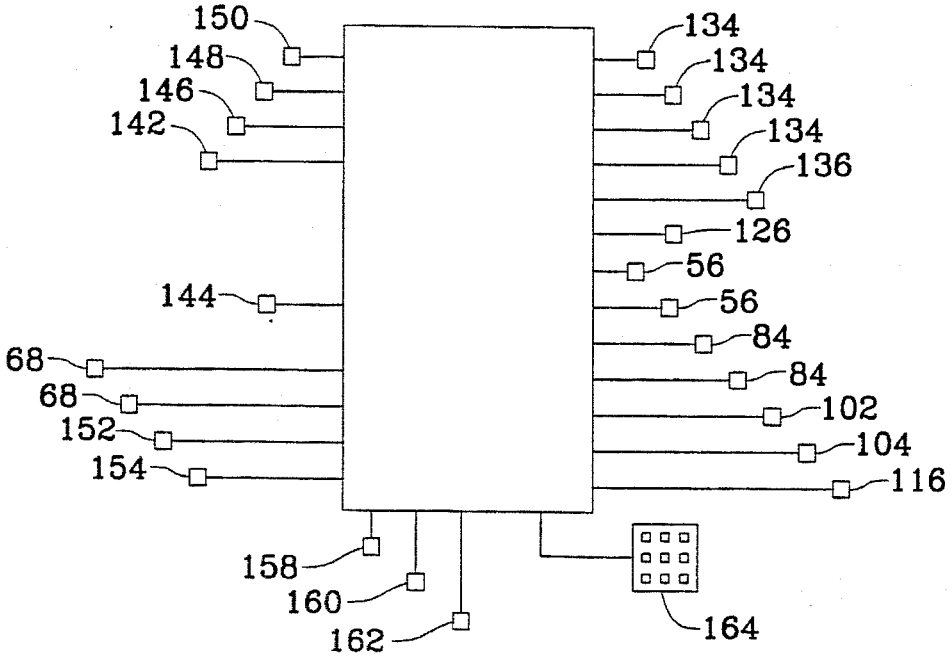
FIG. 6 is a schematic illustration of the control system which controls various components and operational aspects of the apparatus.
Figure 7A:
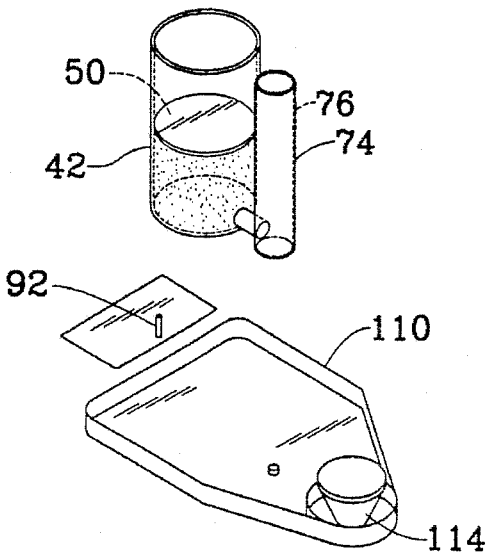
Figure 7B:
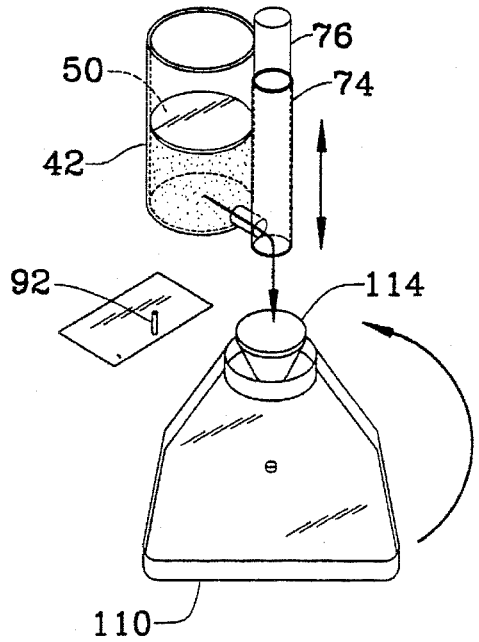
Figure 7C:
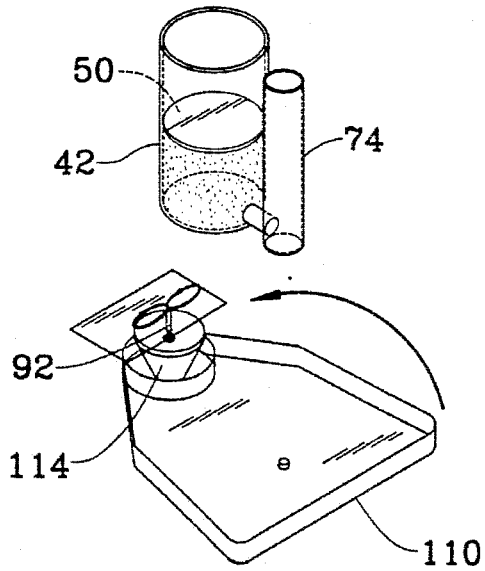
Figure 7D:
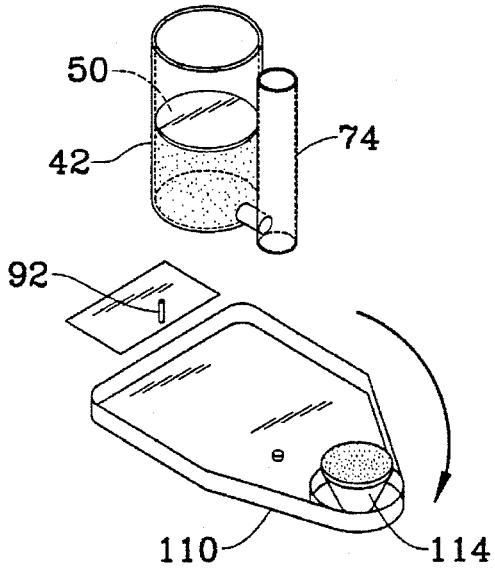

FIG. 6 generally depicts the controller 140 that is used to control various components of the apparatus. The controller 140, which may be in the form of a microprocessor, receives inputs from a hot water sensor 142 which senses the temperature of the water in the hot water tank 124 and a refrigerator sensor 144 which senses the temperature within the refrigerated section 26 of the housing. If the temperature of the water in the water tank falls below the desired level the controller causes actuation of the heater 126, and once the temperature of the water in the tank 124 reaches the desired level the controller 140 turns the heater 126 off. Similarly, the controller 140 activates and deactivates the refrigeration unit to maintain the temperature in the refrigerated section 26 at a level that will keep the soup concentrate within a temperature range of about 33° F.–40° F., preferably about 35° F.–40° F.

Also input into the microprocessor 140 are output signals from three water level sensors that consist of a low water level sensor 146, a middle water level sensor 148, and a high water level sensor 150. The low water level sensor 146 is designed to ensure that the water level in the tank 124 does not fall below the level at which is located the line that is connected to the nozzle 92. If the water were to fall below this level, steam rather than water would be delivered to the nozzle 92. When the water level approaches this level, the controller 140 causes water to be delivered to the tank 124.

The middle water level sensor 148 senses the water level in the tank 124 during the initial filling of the tank. Once the water level reaches the middle level sensor 148, the filling process is stopped. This middle water level sensor 148 is necessary because the water expands upon being heated and so it is desirable to provide room for expansion at the top of the tank 124.

The high level water sensor 150 sends a signal to the controller 140 if the water level exceeds a certain level in the tank 124 after being heated. In such a situation, the controller 140 opens the line connecting the tank 124 to the vent 132.

The microcomputer 140 further receives input signals from four position sensors 68, 68 152, 154. As described above, the position sensors 68, 68 are each associated with one of the piston driving devices 54 and are adapted to determine when the drive rod 58 has reached its uppermost position.

The position sensor 152 is designed to determine whether the tray 110 is properly oriented as well as whether the tray 110 is positioned at the appropriate place in the lower section 24 of the housing 22. As illustrated in FIG. 3, the sensor 152 can be in the form of a Hall effect sensor that interacts with a magnet 156 disposed on the bottom of the tray 110. The sensor 152 is useful in helping to ensure not only that the tray 110 is present, but is properly oriented at a home position each time one of the dispenser buttons 158, 160 is actuated. In that way, it can be ensured that the amount of rotation of the tray 110 during each of the various stages of operation properly positions the cup 114 that is located on the tray 110. If one of the dispenser button 158, 160 is actuated and the sensor 152 detects that the tray 110 is not at the home position, the controller 140 will cause the tray 110 to move until the tray is located at the home position. Also, the mechanisms which effect the discharge of soup concentrate and hot water will be disabled if the sensor 152 determines that the tray 110 is not in the home position. Further, to the extent the tray 110 is not positioned in the lower section 24 of the housing 22 when one of the dispenser buttons 158, 160 is actuated (e.g., the tray has been removed), a signal is sent to the controller 140 to prevent operation of the mechanisms which dispense soup concentrate and hot water.

The sensor 154 is adapted to detect the presence of a cup 114 on the tray 110 as well as whether the cup 114 is filled with soup. With reference to FIG. 2, the position sensor 154 can be in the form of a photocell positioned on the cover 30 that extends across the front of the lower section 24. The sensor 154 determines whether a cup 114 is present on the tray by detecting a lip of the cup. If a cup 114 is not present on the tray 110, the controller 140 will not permit a soup making operation to be initiated. The sensor 154 determines whether the cup 114 is full by sensing when the cup from a previous soup making operation is removed from the tray 110. After a soup making operation is completed, an appropriate signal (e.g., an intermittent beep) will provide notice that the cup of soup must be removed. Until the full cup of soup is removed, the controller will not permit another soup making operation to begin.

As further seen in FIG. 6, the microprocessor 140 outputs signals for effecting control of the various valves 134 and the sub-cooling valve 136 associated with the piping system shown in FIG. 5. Further, signals are outputted to control the piston drive device 56 and displacer piston driving device 84 associated with each of the soup concentrate dispensers 42. Likewise, the controller 140 outputs signals to control the operation of the nozzle drive devices 102, 104 and the tray drive mechanism 116. Further, the heater 126 that heats the water in the water tank 124 is controlled by an output signal from the microprocessor 140.

Control signals are also sent to the microprocessor 140 upon actuation of the dispenser switches 158, 160 as well as the on/off switch 162. Also connected to the controller 140 is a keyboard 164 which allows the input of various forms of information relevant to the soup making operation. For example, information concerning the size of the cup 114 to be filled can be inputted on the keyboard. The system can then be designed to automatically adjust the amount of soup concentrate discharged from the soup concentrate container 42 as well as the amount of water delivered by the nozzle 92. Further, the system can be designed so that when information regarding the size of the cup 114 is inputted on the keyboard 164, the path of movement traversed by the water nozzle 92 is also changed to ensure that the entire bottom or substantially the entire bottom of the cup 114 is covered with the spray path to thereby effect proper mixing.

Having described the features of the apparatus, the operation will now be described with reference to FIGS. 7(*a*)–7(*d*). FIG. 7(*a*) illustrates the initial or first position of the tray 110 before actuation of one of the dispenser switches 158, 160. In this position, the transfer piston 76 is located in its lowermost or substantially lowermost position within the transfer cylinder 74. Further, the forward end of the tray 110 extends through the opening 120 in the cover 30 at the front of the housing 22 for allowing a cup or other similar receptacle 114 to be manually positioned on the tray 110. The apparatus could also be appropriately designed to automatically place a cup on the tray 110.

When one of the dispenser switches 158, 160 is actuated, the Hall effect sensor 152 determines whether the tray 110 is properly positioned within the lower section 24 of the housing and whether the tray 110 is located at the home position. Further, the photocell 154 will determine if a cup is present on the tray 110 and whether the cup is full. Assuming the Hall effect sensor 152 determines that a tray 110 is present and that the tray 110 is properly oriented, and assuming the photocell 154 determines that a cup 114 is present on the tray and that the cup 114 is not a full cup, the tray driving device 116, under the control of the microcomputer 140, will cause the tray 110 to begin rotating. If the dispenser switch 158 on the right side of the apparatus is actuated to select the type of soup produced from the soup concentrate located in the soup concentrate container 42 on the right side of the machine, the tray 110 will rotate in a counter clockwise direction as seen from above in FIG. 7(*b*). On the other hand, if the other dispenser switch 160 is actuated to produce soup from the soup concentrate located in the soup concentrate container 42 positioned on the left side of the apparatus, the tray 110 will rotate in the clockwise direction as seen from above. In either case, the tray is rotated approximately 120° to position the cup 114 underneath the outlet defined at the bottom end of the transfer cylinder 74.

The controller 140 can be designed to turn on the heater 126 in the water tank 124 as soon as the tray 110 begins rotating from the first or initial position. Such a mode of operation is advantageous as a way of imparting additional heat to the water in the tank 124 in anticipation of the loss of heat that will occur soon thereafter when the hot water that is sprayed out of the nozzle is replaced with cold water from the cold water inlet 128.

As the tray 110 is rotating from the first position to the second position shown in FIG. 7(*b*), the drive device 84 for the transfer piston 76 begins operation under the control of the microcomputer 140 to move the transfer piston 76 upwardly within the transfer cylinder 74. When the tray 110 reaches the second position shown in FIG. 7(*b*), the piston drive device 54 for moving the piston 50 downwardly within the soup concentrate container 42 is actuated under the control of the microprocessor 140. The piston drive device 54 is actuated for a period of time that will cause the piston 50 to move a distance sufficient to discharge a predetermined quantity of soup concentrate out of the soup concentrate container 42. While the piston 50 is moving downwardly within the soup concentrate container 42, or possibly after the downward movement of the piston 50 is completed, the transfer piston 76 begins moving downwardly within the transfer cylinder 74 through operation of the drive device 64. Once the transfer piston 76 completes its downward movement, the predetermined amount of soup concentrate will be discharged from the transfer cylinder 74 and into the cup 114.

The tray driving device 116 then continues the rotational movement of the tray 110 in the same direction until the tray 110 reaches a third position in which the cup or receptacle 114 is located below the nozzle 92. At this point, the valve 134 disposed in the line connecting the nozzle 92 to the water tank 124 is opened to direct hot water flow to the nozzle 92. While hot water is flowing to the nozzle 92, the sub-cooling valve 136 is intermittently operated to deliver pulses of cold water to the line interconnecting the nozzle 92 and the water tank 124. As noted above, this mixing of cold water with the hot water helps avoid flashing in the nozzle 92 or upstream of the nozzle.

Before or at the same time as when the hot water stream is discharged from the nozzle 92, the nozzle driving motors 102, 104 begin operation under the control of the microprocessor 140 to effect the pivoting movement of the nozzle 92. Thus, as the stream of hot water is delivered into the underlying cup or receptacle 114, the stream traverses a path that covers substantially the entire bottom surface of the cup to thereby effect a complete and thorough mixing of the soup concentrate with the hot water. Once the amount of hot water necessary for producing the final soup product has been delivered to the cup 114, the hot water valve 134 is turned off, the sub-cooling valve 136 is turned off, and the motors 102, 104 for driving the nozzle 92 are turned off.

The tray driving device 116 once again becomes operational to rotate the tray 110 in the opposite direction to return the tray 110 to its original position at which the cup of soup 114 can be removed. For an 8 oz. cup of soup, the total time of operation for one cycle of the machine in which the tray 110 is moved from the first position, to the second position, to the third position and then returned to the first position is on the order of 20–25 seconds, preferably about 20 seconds.

Once the tray 110 returns to its original position, the photocell 154 senses the full cup of soup and sets off a signal to indicate that the cup 114 can be removed from the tray. As noted above, the control system can be designed to provide a periodic signal indicating the presence of a full cup of soup. This signal can continue until the full cup of soup is removed.

The nozzle 92 should preferably be designed to provide a well conditioned flow of hot water into the cup to control foam production and avoid excessive splashing. A nozzle having a diameter of about 0.060 in. –0.090 in. with a flow velocity of 50 ft./sec. has been found to be effective. Further, it is desirable that the cup be positioned far enough away from the overlying top wall 200 (see FIG. 3) that if some small amount of splashing does occur, the soup does not splash onto the top wall 200. Such a situation would be undesirable since soup which has splashed onto the top wall 200 might drip down into the underlying cup during successive soup making cycles. Thus, it is preferable that the overlying top wall 200 be spaced approximately 3 in. above the top of the cup.

It can be readily appreciated that the apparatus according to the present invention is advantageous in several respects. For instance, individualized servings of hot soup can be produced in a relatively short period of time. Also, the apparatus is well suited to facilitating portion control. Since the apparatus is provided with dual soup concentrate containers, a single apparatus can be used to produce two different flavors or types of soup. Thus, the apparatus possesses versatility in use. Further, the removable nature of the soup concentrate containers 42 makes it very easy to either refill an empty container with a different type/flavor of soup concentrate or replace one container with another container that contains a different type/flavor of soup.

In addition, because the apparatus is designed to mix the soup directly in the serving cup, the need for a separate mixing container is avoided. Further, since the spray nozzle serves the dual function of delivering hot water and mixing the hot water with the soup concentrate, the construction of the apparatus is simplified since a separate mixing or stirring device is unnecessary.

It is to be understood that various features and characteristics of the apparatus according to the present invention as described above can be altered or interchanged with other features and characteristics. For example, instead of designing the apparatus so that the tray undergoes a three stage movement cycle in which it moves from a first position, to a second position, to a third position and back to the first position, the apparatus can be designed so that the tray undergoes a two stage movement cycle. This can be accomplished by positioning the water nozzle 92 and the soup concentrate containers 42 in a way that would allow the soup concentrate and the water to be delivered to the cup while the cup is in the same position between the two soup concentrate containers 42.

As an alternative to the single rotating tray 110 described above, the apparatus can be provided with two linearly movable trays as seen in FIG. 11. Here, two trays 170, 172 are arranged side-by-side and are movable in a linear manner. The apparatus is also provided with two soup concentrate containers 42 each of which has a displacer assembly 72 associated therewith. Each of the soup concentrate containers 42 and the displacer assemblies 72 can possess features similar to those described above. In the embodiment shown in FIG. 11, however, since the cup receiving trays 172 are movable in a linear manner, rather than a rotational manner, it is preferable that a separate nozzle 92 be provided for each side. Each of the nozzles 92 is positioned behind a respective one of the displacer assemblies 72. Both nozzles 92 can be connected to a single hot water tank for delivering hot water to each of the nozzles 92.

The embodiment of the apparatus illustrated in FIG. 11 can be designed to effect a three-step linear movement of the tray. That is, the trays can be moved from the initial position shown in FIG. 11 to a second position in which the cup received on the tray 172 is disposed below the outlet end of the transfer cylinder of the displacer assembly 72. The tray is then moved to a third position at which the cup on the tray 172 is disposed below the nozzle 92. At this step, hot water is delivered into the cup containing the soup concentrate and a mixing action is effected through pivoting movement of the nozzle 92. Thereafter, the tray 172 is returned to the initial position to permit removal of the cup containing the hot soup. As was the case with the embodiment described above, it may be possible to position the nozzles 92 close enough to the respective displacer assembly 72 to permit a two-step movement of the trays. That is, it may be possible to position the nozzle 92 so that when the cup is positioned below the displacer assembly 72, the nozzle 92 can direct a stream of hot water into the cup and also perform the necessary mixing function.

In addition, in the embodiment shown in FIG. 11, the front end 174, 176 of the two trays 170, 172 is sized and configured to be the same as or substantially the same as the size and configuration of the slot 120 in the cover 30 on the housing 22 (see FIG. 1). As a result, when the trays 170, 172 are in the position at which mixing of the hot water and soup concentrate is effected, the slot 120 in the front cover is closed to prevent soup product from splashing out of the container and to avoid having an individual inadvertently stick their fingers into the slot during operation of the apparatus.

The linearly movable trays illustrated in FIG. 11 possess certain advantages with respect to the rotational tray utilized in the embodiment described above. In one respect, the amount of movement experienced by the linearly movable trays 170, 172 as they move from the initial position to the second position, to the third position and back to the first position is significantly less than the amount of movement performed by the rotational tray 110. Also, the embodiment of the apparatus in which linearly movable trays 170, 172 are employed allows a cup of soup to be produced on either side of the apparatus at the same time, thereby increasing the potential output of the machine.

FIGS. 12(*a*) and 12(*b*) illustrate an alternative to the displacer assembly described above. Instead of the displacer assembly, a gate valve or guillotine valve 180 can be employed. The gate valve or guillotine valve 180 is shown in the closed position in FIG. 12(*a*) and is depicted in the opened position in FIG. 12(*b*).

One of the desirable attributes associated with the valve 180 shown in FIGS. 12(*a*) and 12(*b*) is that the cycle time associated with the movement of the transfer piston of the displacer assembly can be eliminated. However, in using the valve arrangement shown in FIGS. 12(*a*) and 12(*b*), the soup concentrate must possess a consistency or viscosity, preferably through temperature control, which will allow the predetermined amount of soup concentrate discharged from the soup concentrate container 42 to be discharged through the outlet end of the valve 180 without requiring a separate element to push the soup concentrate out of the valve.

FIGS. 8 and 9 illustrate alternative driving arrangements for effecting the pivoting movement of the nozzle 92. In the embodiment shown in FIG. 8, the motors and cranks described above are replaced with spring loaded solenoids 184, 186 which are connected to the nozzle 92 at positions spaced apart approximately 90 degrees from one another. Each of the spring loaded solenoids 184, 186 causes the nozzle 92 to pivot in a plane perpendicular to the plane of movement caused by the operation of the other spring loaded solenoid. Operating the two spring loaded solenoids 184, 186 by controlling the position of the output shaft of each solenoid 184, 186 (i.e., the axial movement of the solenoid shafts) allows the hot water stream from the nozzle 92 to be positioned anywhere or substantially anywhere on the bottom surface of the cup. It is possible, therefore, to provide infinite or substantially infinite adjustability and arbitrary positioning of the nozzle stream in the bottom of the cup.

One advantage associated with the use of the spring loaded solenoids 184, 186 is that they are better suited to providing a path of movement of the stream of hot water that completely covers the bottom surface of the cup. It has been found that when the driving arrangement for the nozzle is a motor and crank arrangement similar to that shown in FIG. 3, the outline of the outer reaches of the water stream defines a generally rectangular path so that small portions of the bottom surface of the cup may not be covered with the hot water stream. Since the stroke of each of the spring loaded solenoids 184, 186 can be varied, it is possible to more precisely control the movement path of the hot water stream by controlling the pivoting movement of the nozzle 92. In fact, the system could be designed so that for each cup having a different size or configuration, the nozzle 92 traverses a different movement path to thereby ensure that different cups having bottom surfaces of different sizes and configurations are completely covered with the hot water stream, thereby maximizing the mixing effectiveness associated with the nozzle movement.

FIG. 9 illustrates a further alternative to the motor/crank axis arrangement described above. In this alternative, a magnet or pole piece 190 is operatively associated with the nozzle 92 and a plurality of excitation coils 192 are disposed in surrounding relation to the magnet or pole piece 190. Through appropriate excitation of the electromagnetic coils 192, the desired movement of the nozzle can be effected. FIG. 10 illustrates a general pattern traversed by the hot water stream using the arrangements shown in FIGS. 9 and 10. As can be seen, the outer confines of the movement path defines a circle. By appropriately controlling the timing and degree of excitation of the electromagnetic coils 192, the size and configuration of the path traversed by the hot water stream can be altered as desired to suit different size cups.

The soup concentrate used in connection with the apparatus described above can be similar to that which is disclosed in U.S. patent application Ser. No. 08/088,351 filed on Jul. 9, 1993, at a ratio of about 1.6 parts water to about 1.0 part concentrate.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. An apparatus for producing hot soup from a soup concentrate, comprising:

a housing;

a pair of soup concentrate containers positioned within the housing for holding soup concentrate;

cooling means for maintaining soup concentrate in the soup concentrate containers below a predetermined temperature;

a pair of outlets each communicating with a respective one of said soup concentrate containers;

discharging means operatively associated with each soup concentrate container for discharging a predetermined amount of soup concentrate through the respective outlet;

a water tank connected to the housing for holding water;

heating means for heating water in the water tank;

a nozzle connected to said water tank by a hot water line for discharging a stream of hot water from the water tank;

a tray for supporting a cup;

tray driving means for moving said tray;

control means for controlling said tray driving means to move said tray between a plurality of positions including a first position for placing a cup on the tray, a second position in which a cup on the tray is located below one of said outlets to receive the predetermined amount of soup concentrate, and a third position in which a cup on the tray having soup concentrate therein is located below the nozzle to receive hot water, said control means moving the tray back to said first position after said third position; and nozzle drive means connected to the nozzle for moving the nozzle to cause the hot water stream exiting the nozzle to move across a bottom of the cup positioned on the tray when the tray is in the third position to thereby cause the soup concentrate and the hot water to be mixed.

2. An apparatus according to claim 1, wherein said housing includes a first section and a second section, said soup concentrate containers being located in said first section, said cooling means causing said first section to be refrigerated.

3. An apparatus according to claim 1, wherein each of said soup concentrate containers is removable from said housing, each soup concentrate container having a side wall and an opening in the side wall, and a nozzle ring encircling each soup concentrate container, each nozzle ring having a through hole which is alignable with the opening in the respective soup concentrate container.

4. An apparatus according to claim 3, wherein said nozzle ring is rotatable with respect to said soup concentrate container to move the through hole in the nozzle ring out of alignment with the through hole in the soup concentrate container.

5. An apparatus according to claim 1, wherein said discharging means includes a container piston movably positioned within each soup concentrate container and a piston driving device operatively associated with each container piston to urge the piston downwardly within the respective soup concentrate container.

6. An apparatus according to claim 5, including a pair of transfer cylinders and a transfer piston positioned within each transfer cylinder, each transfer cylinder being in communication with a respective one of the soup concentrate containers so that soup concentrate discharged out of the soup concentrate container through the downward movement of the piston is directed into the respective transfer cylinder, and a transfer piston driving device connected to each transfer piston for driving the transfer piston in opposite directions within the respective transfer cylinder to force soup concentrate in the transfer cylinder into an underlying cup.

7. An apparatus according to claim 5, including an openable and closable valve connected to each soup concentrate container adjacent a bottom end thereof.

8. An apparatus according to claim 1, wherein said tray driving means includes means for rotationally moving said tray.

9. An apparatus according to claim 1, wherein said tray driving device includes means for moving the tray linearly between said first position, said second position, and said third position.

10. An apparatus according to claim 9, including a second nozzle for producing a stream of hot water, a second tray for supporting a cup, and a second tray driving means for driving the second tray, said second tray driving means moving said second tray in a linear manner between a first position for placing a cup on the second tray, a second position in which a cup on the second tray is located below one of the outlets to receive the predetermined amount of soup concentrate, and a third position in which a cup on the second tray having soup concentrate therein is located below the second nozzle to receive hot water and produce hot soup.

11. An apparatus according to claim 1, wherein a tip portion of said nozzle extends through a hole provided in a mounting member made of flexible material to pivotally mount the nozzle and allow the nozzle to pivot as a result of operation of said nozzle drive means.

12. An apparatus according to claim 1, wherein said nozzle drive means includes two drive units each having a drive shaft connected to the nozzle, one of the drive units moving the nozzle in a first plane of movement and the other drive unit moving the nozzle in a second plane of movement that is different from said first plane of movement.

13. An apparatus according to claim 1, wherein said housing includes a front face having a slotted opening, said tray having a rearward end and an oppositely positioned forward end, the forward end of the tray extending out of the housing when the tray is in the first position, one of said forward and rearward ends of the tray being configured and sized to substantially correspond to a configuration and size of the slotted opening in the front face of the housing so that when said tray is in the third position the slotted opening in the housing is substantially closed.

14. An apparatus according to claim 1, and including a cold water line conduit connected to said hot water line to introduce cold water into the hot water line.

15. An apparatus according to claim 1, wherein said nozzle drive means includes a magnet mounted on the nozzle and a plurality of excitation coils surrounding the magnet.

16. An apparatus according to claim 1, wherein said nozzle drive means includes a plurality of solenoids connected to said nozzle.

17. An apparatus for producing a soup product from a soup concentrate, comprising:

a housing having a refrigerated first section and a second section which are separate from one another;

a soup concentrate container positioned within the refrigerated section for receiving soup concentrate;

a discharge device operatively associated with said soup concentrate container for discharging a predetermined amount of soup concentrate from said soup concentrate container;

hot water conveying means for conveying hot water from a hot water source to said nozzle;

a nozzle positioned in the second section for producing a stream of hot water;

a movable receptacle receiving tray positioned in the second section for receiving a receptacle in which is to be mixed hot water and soup concentrate;

a receptacle receiving tray driving device connected to the receptacle receiving tray for moving the receptacle receiving tray between a plurality of positions including an initial position for placement of a receptacle on the receptacle receiving tray, and at least one other position of which a receptacle on the receptacle receiving tray is positioned to receive a predetermined amount of soup concentrate discharged by the discharge device and a predetermined amount of hot water from the nozzle; and a nozzle driving device connected to the nozzle for moving the nozzle and effecting a stirring action within the receptacle through movement of the hot water stream to mix the hot water and soup concentrate in the receptacle.

18. An apparatus according to claim 17, wherein said nozzle is mounted at a pivot point adjacent a tip end of the nozzle to effect pivoting movement of the nozzle during operation of the nozzle driving device.

19. An apparatus according to claim 18, wherein said nozzle is mounted on a mounting member made of flexible material.

20. An apparatus according to claim 17, wherein said soup concentrate container is provided with an opening through which the soup concentrate in the soup concentrate container is discharged, said discharge device including a piston movably positioned within the soup concentrate container and a drive rod connected to a drive device for moving the piston towards said opening in the soup concentrate container.

21. An apparatus according to claim 17, including a cold water conveying means for being connected to a source of cold water, said cold water conveying means being connected to said hot water conveying means for conveying cold water to said hot water conveying means.

22. An apparatus according to claim 17, including means for determining the presence of a receptacle on the receptacle receiving tray.

23. An apparatus according to claim 17, including means for determining if the receptacle receiving tray is located in the second section.

24. A method of producing individual servings of soup concentrate in a cup, comprising:

placing a cup on a movable tray located at a first position;

moving the tray to a second position;

discharging a predetermined amount of soup concentrate into the cup;

directing a stream of hot water through a nozzle and into the cup containing the predetermined amount of soup concentrate while simultaneously moving the nozzle so that the stream of hot water moves across a bottom of the cup to effect mixing of the hot water and the soup concentrate; and moving the tray to a cup removal position at which the cup is positioned to be removed from the tray.

25. A method according to claim 24, wherein said tray is moved to a third position after the predetermined amount of soup concentrate is discharged into the cup, the stream of hot water being directed into the cup when the tray is at said third position.

26. A method according to claim 24, wherein hot water is conveyed from a hot water tank to the nozzle by way of a hot water line, and including introducing cold water into the hot water line to avoid flashing.

27. A method according to claim 24, wherein said nozzle is moved by pivoting the nozzle under the driving action of a driving device.

* * * * *